US005558474A

United States Patent [19]

Wildon

[11] Patent Number: 5,558,474

[45] Date of Patent: Sep. 24, 1996

[54] APPARATUS FOR DISCHARGING PARTICULATE MATERIAL

[76] Inventor: Kevin Wildon, 31 Hall Lane, Hindley, Wigan WN2 2SA, England

[21] Appl. No.: 218,890

[22] Filed: Mar. 28, 1994

Related U.S. Application Data

[63] Continuation of Ser. No. 938,674, Sep. 1, 1992, abandoned, which is a continuation of Ser. No. 555,802, Jul. 23, 1990, abandoned, which is a continuation of Ser. No. 259,398, Oct. 18, 1988, abandoned, which is a continuation of Ser. No. 856,349, Apr. 28, 1986, abandoned.

[30] Foreign Application Priority Data

| | | | |
|---|---|---|---|
| May 1, 1985 | [GB] | United Kingdom | 8511122 |
| May 14, 1985 | [GB] | United Kingdom | 8512166 |
| Dec. 19, 1985 | [GB] | United Kingdom | 85312499 |

[51] Int. Cl.[6] ..... B65G 53/42

[52] U.S. Cl. ..... 406/127; 406/146; 406/154

[58] Field of Search ..... 406/122, 127, 406/146, 154, 144; 239/365

[56] References Cited

U.S. PATENT DOCUMENTS

| | | | |
|---|---|---|---|
| 1,559,666 | 11/1925 | Bernier | 406/146 |
| 3,070,924 | 1/1963 | Hastrup | 51/438 |
| 3,201,901 | 8/1965 | Pauli | 51/436 |
| 3,834,082 | 9/1974 | Grudzinski | 51/436 |
| 4,090,334 | 5/1978 | Kurowski et al. | 51/438 |
| 4,135,068 | 1/1979 | Burns | 51/436 |
| 4,685,622 | 8/1987 | Shimohira et al. | 239/365 |

FOREIGN PATENT DOCUMENTS

| | | | |
|---|---|---|---|
| 2303252 | 8/1973 | Germany | 406/146 |
| 2248859 | 10/1975 | Germany . | |
| 3025895 | 2/1982 | Germany . | |

*Primary Examiner*—Gary C. Hoge
*Attorney, Agent, or Firm*—William R. Hinds

[57] ABSTRACT

Apparatus 10 for discharging particulate material such as sand has a container 11 for the material, a supply conduit 20 for pressure gas, e.g. air, connected to an inlet 16 and via pipe 17 to an outlet 12 and a flexible discharge conduit 14 leading to nozzle 15. Flow in conduit 20 is controlled by a manually operable valve 21 biassed closed and when open gas and particulate material flow forcefully through nozzle 15. All the gas goes through valve 21. The apparatus can thus be controlled by an operative remote from the container 11 without consumption of pressure gas when valve 21 is closed. The valve 21 is mounted for convenient operation by a user. In a modification the valve 21 is nearer the container and operated from near the nozzle through a mechanical connection.

18 Claims, 2 Drawing Sheets

APPARATUS FOR DISCHARGING PARTICULATE MATERIAL

This is a continuation of application Ser. No. 07/938,674 filed Sep. 1, 1992, now abandoned which is a continuation of Ser. No. 07/555,802 filed Jul. 23, 1990, now abandoned, which is a continuation of Ser. No. 07/259,398 filed Oct. 18, 1988, now abandoned, which is a continuation of Ser. No. 06/856,349 filed Apr. 28, 1986, now abandoned.

This invention relates to apparatus for discharging particulate material and finds particular, but not exclusive, use in the discharge of sand, for example in the cleaning of walls of buildings.

According to the invention apparatus for discharging particulate material comprises a container for particulate material, an inlet conduit for supplying gas under pressure to the container for pressurizing the container, an outlet from the container for particulate material, first valve means for controlling flow of particulate material through the outlet, a discharge conduit connecting the outlet to a discharge outlet for gas and particulate material, said discharge conduit comprising a flexible elongate member, and second valve means in the inlet conduit for controlling flow of pressure gas, said second valve means being operable remote from the container without loss of pressure gas and having open, closed and intermediate positions.

The second valve means may be adjacent the discharge outlet and may be mounted on an outlet nozzle of said discharge outlet. The second valve means may be a single valve in the inlet conduit and may be biassed to a closed condition.

There may be a passage connecting the inlet conduit, downstream of the second valve means, and the outlet for supplying pressure gas to the outlet, and including third valve means for controlling flow in the passage.

There may be a flexible elongate control element extending from adjacent the discharge outlet to the second valve means for operating the second valve means. The end of the control element nearer the discharge outlet may be connected to a slide member slidable on the discharge conduit for operating the second valve means. There may be means biassing the slide member to a position in which the second valve means is closed.

A water filter may be in the inlet conduit downstream of the second valve means.

The second valve means may be operable through a mechanical connection.

The second valve means may be continuously adjustable between open and closed positions.

Also according to the invention apparatus for discharging particulate material may comprise a container for particulate material, an inlet conduit for supplying gas under pressure to the container for pressurizing the container, an outlet from the container for particulate material, first valve means for controlling flow of particulate material through the outlet, a discharge conduit connecting the outlet to a discharge outlet for gas and particulate material, said discharge conduit comprising a flexible elongate member, and second valve means in the inlet conduit for controlling flow of pressure gas, the second valve means being operable remote from the container through mechanical means and has open, closed and intermediate positions. The mechanical means may comprise a manually operable member forming part of the second valve means.

The invention may be performed in various ways and two specific embodiments with possible modifications will now be described by way of example with reference to the accompanying diagrammatic drawings in which.

Figure 1:
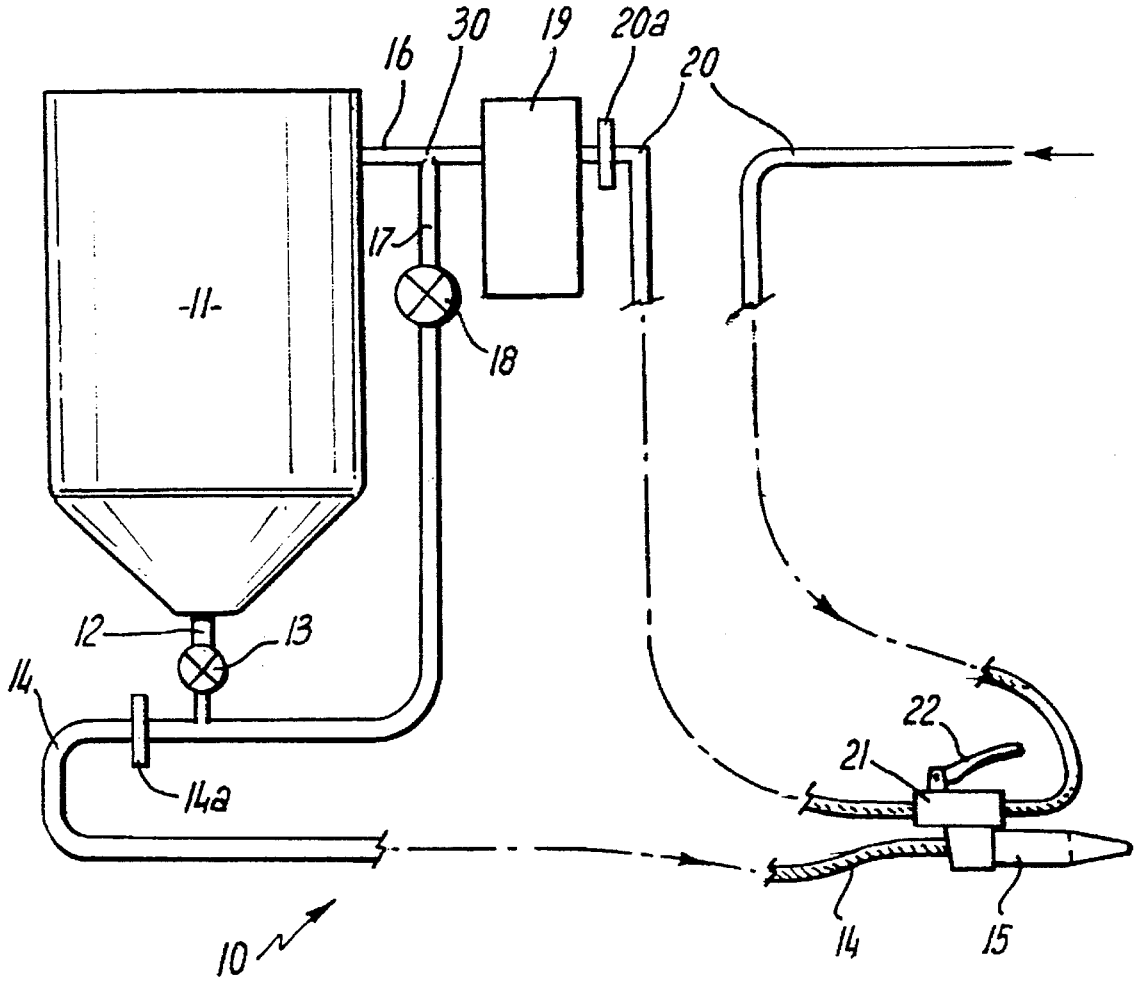
FIG. 1 is a view of sand blasting apparatus.

In FIG. 1 a sand blasting apparatus 10 comprises a container 11 for sand having at its lower end an outlet pipe 12, including a manually operable flow-control valve 13 for controlling flow of the abrasive or sand, connected via coupling 14*a* to a flexible elongate hose 14 having a discharge nozzle 15 at its outer end. An inlet pipe 16 to an upper region of the container 11 has a T connection to a pipe 17 connected to the pipe 12 and the inner end of the hose 14. A manually operable flow-control valve 18 is located in the pipe 17. The outer end of the inlet pipe 16 is connected to a water filter 19 which in use receives air under pressure from a suitable source, for example a compressor driven by an internal combustion engine, through a flexible hose 20 via coupling 20*a*. The hose 20 includes a valve 21, manually operable by a handle or lever 22, which is mounted on or close to the nozzle 15. The valve 21 could be mounted on the operator's person or in another position convenient to him.

The sand in the container can be replenished through a filling opening which is normally open but which is closed by a valve responsive to pressure air in the pipe 16.

In use, the valves 13, 18 are partly or fully opened and an operative moves the handle 22 to open the valve 21 to a desired amount. The handle 22 can be moved to adjust the valve continuously or infinitely between fully on and fully off. The handle 22 effects a mechanical control of the valve 21. Pressure air then flows through the hose 20, valve 21 and filter 19 to pipes 16, 17, 12 and hose 14. Pressure air in the container 11 is thus substantially balanced. Sand is drawn under gravity from the container 11 through the valve 13 and the sand is forced through the hose 14 to discharge through the nozzle 15. On release of the handle 22 the valve 21 is closed by a return spring (not shown). The amount of sand discharged is controlled by the setting of valve 13.

Instead of air another gas (e.g. inert) could be used. The valve 21 can be held at any desired intermediate position for example to obtain low-pressure blast. The valve 21 is protected by the water filter from damage by sand should there be any reverse flow. If flow of sand is reduced or stopped by a clot of sand, valve 18 is closed to clear the obstruction.

With the described arrangement, no pressure air is drawn from the pressure source when the valve 21 is closed and manipulation of the nozzle and operation of lever 22 are effected by the same operative who is or can be remote from the container 11 and valves 13, 18.

This is to be contrasted with a system in which valve 21 is not present and air flows from the compressor directly to filter 19 and the control of air and sand flow through the nozzle is by an additional valve in pipe 16 between the filter 19 and the junction 30 between pipe 16 and pipe 17. This additional valve can be operated manually, which may require a second operative when the nozzle 15 is remote from container 11. This additional valve may be operated through one or two additional air pipes extending between the additional valve and a control device for the additional valve, which valve control device is near the nozzle; however in this system, when the additional valve is closed, pressure air is continuously blown off to atmosphere through the valve control device. Because of the additional valve the filter 19 is not close to the container and air flow between the filter and container is subject to turbulence, allowing condensation and entry of water into the container with increased likelihood of blockages.

With the system of FIG. 1 the filter 19 is mounted close to the container 11 reducing turbulence and condensation and producing a smoother operation. The system can operate at any pressure up to maximum working pressure.

In another arrangement the filling opening in the container 11 is normally sealed by a removable screw cap.

The apparatus has been described for use in sand blasting e.g. during cleaning of building walls, but the apparatus can be used to discharge forcefully other particulate material.

Figure 2:
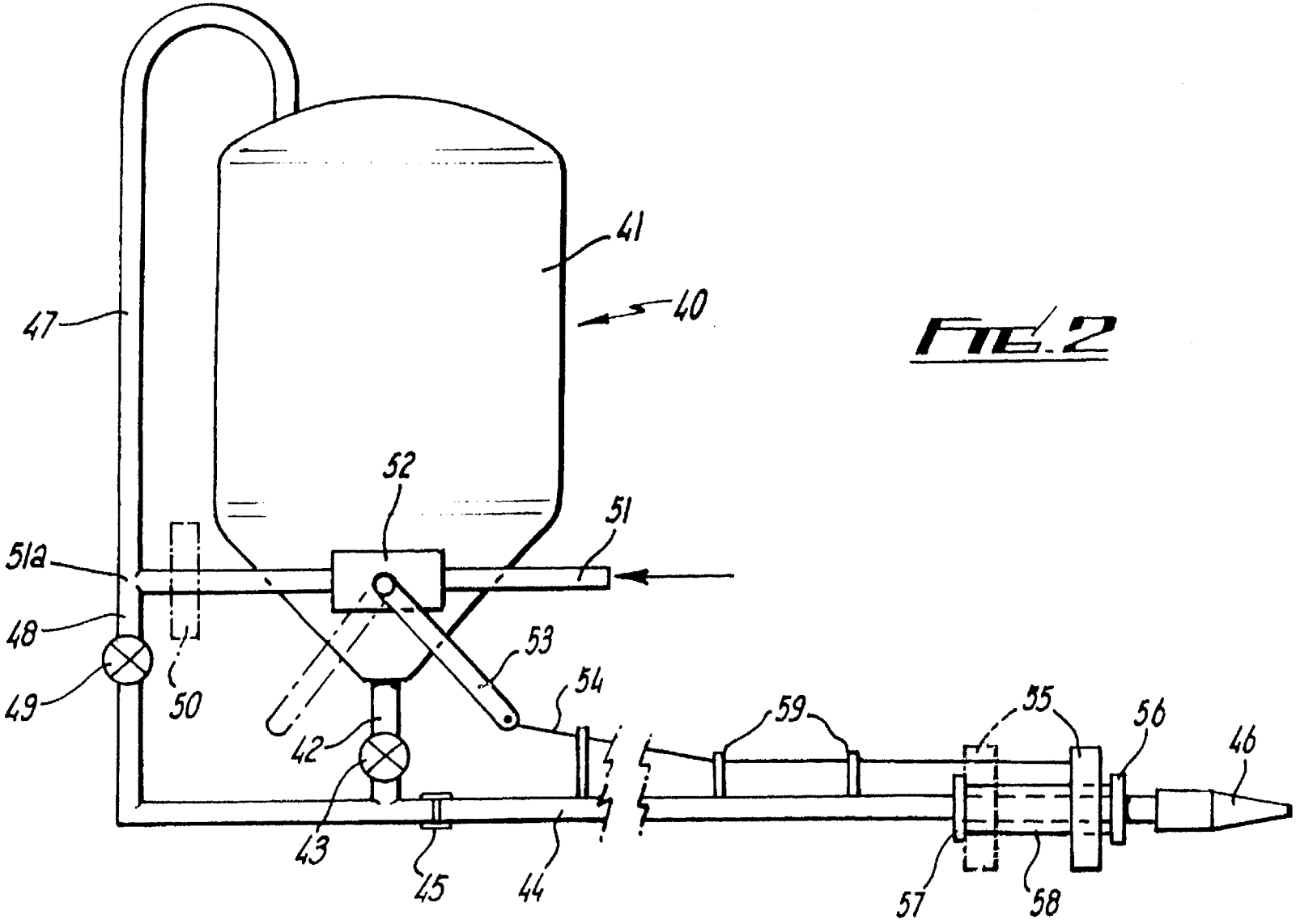
FIG. 2 is a view of another embodiment.

In FIG. 2 a sand blasting apparatus 40 comprises a container 41 for sand having at its lower end an outlet pipe 42, including a manually operable flow-control valve 43 for sand, connected to an elongate flexible hose 44 via coupling 45 having a discharge nozzle 46 at its outer free end remote from the container 41. An inlet pipe 47 to an upper region of the container 41 has a T-connection to a pipe 48 connected via a manually operable flow control valve 49 to the pipe 42 and the inlet to the hose 44. The pipe 51 includes a water filter 50 between a valve 52 and the junction 51*a* between pipes 47, 48 and in use receives air under pressure through pipe 51 from a source (not shown) of compressed sir or other gas.

The pipe 51 includes a flow control valve 52 movable, continuously between open and closed positions by a valve arm 53, shown in full line in the valve-open position and dotted for valve-closed. A spring (not shown) biasses the valve arm 53 to the valve-closed position. A flexible cable or wire 54 connects the arm 53 to a slider 55 axially slidable between forward and rearward end limit stops 56, 57 on a collar 58 on the hose 44 near the nozzle, the cable 54 passing through guides 59 carried by the hose.

The slider 55 is moved manually towards the stop 56 away from stop 57 to open valve 52 to supply air pressure to the vessel to start delivery of sand and pressure air to the nozzle. The further the slider is moved towards stop 56 the greater the rate of discharge of sand from the nozzle and the greater the pressure of air accompanying the discharged sand. Release of the slider allows the spring to close the valve 52.

With the arrangement, the pressure of air leaving the nozzle can be low, say less than 3 pounds per square inch (0.21 Kg per square centimeter); no air is lost through bleed off or signal lines; the valve 52 is simple in operation and is substantially unaffected by water vapour and does not need a water filter between it and the pressure source, which may for example be a compressor driven by an internal combustion engine.

Because the water filter 50 is close to the vessel 41 substantially no turbulence due to control valves is created, downstream between the filter and the vessel, which might lead to condensation of water vapour.

The sand in the container can be replenished through a filling opening which is normally open but which is closed by a valve (not shown) responsive to pressure air in pipe 47. The filling opening could be normally sealed by a removable screw cap.

The apparatus can be used to discharge forcefully other particulate material. The apparatus has a small number of working parts, no expensive valves to maintain, no air signal lines and the water filter can be fitted close to the vessel air inlet.

I claim:

1. Apparatus for discharging particulate material comprising a container for particulate material, an outlet from the container for particulate material, first valve means for controlling flow of particulate material through the outlet, inlet conduit means for supplying gas under pressure to the container for pressurizing the container and for supplying gas under pressure to the container outlet downstream of the first valve means, a discharge conduit connecting the container outlet to a discharge outlet for gas and particulate material, said discharge conduit comprising a flexible elongate member, and second valve means in the inlet conduit for controlling flow of pressure gas, said second valve means having open, closed and intermediate control positions and being operable by means remote from the container without loss of pressure gas from the second valve means in any control position.

2. Apparatus as claimed in claim 1, in which the second valve means is adjacent the discharge outlet.

3. Apparatus as claimed in claim 2, in which the second valve means is mounted on an outlet nozzle of said discharge outlet.

4. Apparatus as claimed in claim 1, in which the second valve means is a single valve in the inlet conduit.

5. Apparatus as claimed in claim 1, in which the second valve means is biassed to a closed condition.

6. Apparatus as claimed in claim 1, comprising a passage connecting the inlet conduit, downstream of the second valve means, and the container outlet for supplying pressure gas to the container outlet, and including third valve means for controlling flow in the passage.

7. Apparatus as claimed in claim 1, including a flexible elongate control element extending from adjacent the discharge outlet to the second valve means for operating the second valve means.

8. Apparatus as claimed in claim 7, in which the end of the control element nearer the discharge outlet is connected to a slide member slidable on the discharge conduit for operating the second valve means.

9. Apparatus as claimed in claim 8, including means biassing the slide member to a position in which the second valve means is closed.

10. Apparatus as claimed in claim 1, in which the second valve means is operable through a mechanical connection.

11. Apparatus as claimed in claim 1, in which the second valve means comprises a manually operable member for operating the second valve means.

12. Apparatus as claimed in claim 1, in which the second valve means is continuously adjustable between the open and closed positions.

13. Apparatus as claimed in claim 1 wherein said second valve means is operable by means independent of the pressure gas.

14. Apparatus for discharging particulate material comprising a container for particulate material, an outlet from the container for particulate material, first valve means for controlling flow of particulate material through the outlet, inlet conduit means for supplying gas under pressure to the container for pressurizing the container and for supplying gas under pressure to the container outlet downstream of the first valve means, a discharge conduit connecting the container outlet to a discharge outlet for gas and particulate material, said discharge conduit comprising a flexible elongate member, and second valve means in the inlet conduit for controlling flow of pressure gas, the second valve means having open, closed and intermediate control positions and being operable by means remote from the container solely through mechanical means.

15. Apparatus as claimed in claim 14, in which said mechanical means comprises a manually operable member forming part of the second valve means.

16. Apparatus as claimed in claim 14 in which the mechanical means comprises an elongate element extending from the remote means to said second valve means, said second valve means being remote from the discharge outlet.

17. Apparatus as claimed in claim 14 wherein said second valve means is operable by means independent of the pressure gas.

18. Apparatus for discharging particulate material comprising a container for particulate material, an inlet conduit for supplying gas under pressure to the container for pressurizing the container, an outlet from the container for particulate material, first valve means for controlling flow of particulate material through the outlet, a conduit for supply of gas under pressure to the outlet, a discharge conduit connecting the outlet to a discharge outlet for gas and particulate material, said discharge conduit comprising a flexible elongate member, and second valve means in the inlet conduit controlling flow of pressure gas, said second valve means being operable remote from the container by means independent of the pressure gas, and having open, closed and intermediate control positions to which said second valve is selectively settable.

* * * * *